US009106022B2

(12) United States Patent
Cai et al.

(10) Patent No.: US 9,106,022 B2
(45) Date of Patent: Aug. 11, 2015

(54) ELECTRICAL CONNECTOR

(71) Applicant: LOTES CO., LTD, Keelung (TW)

(72) Inventors: Youhua Cai, Keelung (TW); Martinson Robert Ronald, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 14/181,375

(22) Filed: Feb. 14, 2014

(65) Prior Publication Data

US 2014/0242839 A1 Aug. 28, 2014

(30) Foreign Application Priority Data

Feb. 22, 2013 (CN) ..... 2013 2 0081101 U

(51) Int. Cl.

| | |
|---|---|
| ***H01R 13/646*** | (2011.01) |
| ***H01R 13/6471*** | (2011.01) |
| *H01R 12/70* | (2011.01) |
| *H01R 13/24* | (2006.01) |

(52) U.S. Cl.

CPC ..... *H01R 13/6471* (2013.01); *H01R 12/7076* (2013.01); *H01R 13/2442* (2013.01)

(58) Field of Classification Search

CPC ..... H01R 23/688; H01R 23/005; H01R 13/65807; H01R 9/097; H05K 3/42

USPC ..... 439/65–82, 660

See application file for complete search history.

(56) References Cited

U.S. PATENT DOCUMENTS

| | | | | |
|---|---|---|---|---|
| 8,535,093 | B1 * | 9/2013 | Mason | 439/607.05 |
| 2006/0148283 | A1 * | 7/2006 | Minich et al. | 439/70 |
| 2010/0330844 | A1 * | 12/2010 | Ito | 439/660 |
| 2011/0070750 | A1 * | 3/2011 | Reisinger et al. | 439/66 |
| 2012/0184151 | A1 * | 7/2012 | Hsu | 439/660 |

* cited by examiner

*Primary Examiner* — Briggitte R Hammond

(74) *Attorney, Agent, or Firm* — Locke Lord LLP; Tim Tingkang Xia, Esq.

(57) ABSTRACT

An electrical connector includes an insulating body having multiple signal receiving slots and at least one grounding receiving slot, multiple signal terminals and at least one grounding terminal respectively received in the signal receiving slots and the grounding receiving slot, a first conducting layer disposed in the grounding receiving slot for shielding the signal terminals, and a solder located in the grounding receiving slot and contacts the first conducting layer and the grounding terminal. The electrical connector may further includes an upper conducting layer and a lower conducting layer, respectively disposed on an upper surface and a lower surface of the insulating body, and multiple through holes surrounding each signal receiving slot. Each through hole has an internally disposed second conducting layer. The upper conducting layer, the lower conducting layer, the first conducting layer and the second conducting layer are conducted.

18 Claims, 4 Drawing Sheets

ELECTRICAL CONNECTOR

CROSS-REFERENCE TO RELATED APPLICATIONS

This non-provisional application claims priority under 35 U.S.C. §119(a) on Patent Application No. 201320081101.7 filed in P.R. China on Feb. 22, 2013, the entire contents of which are hereby incorporated by reference.

Some references, if any, which may include patents, patent applications and various publications, may be cited and discussed in the description of this invention. The citation and/or discussion of such references, if any, is provided merely to clarify the description of the present invention and is not an admission that any such reference is "prior art" to the invention described herein. All references listed, cited and/or discussed in this specification are incorporated herein by reference in their entireties and to the same extent as if each reference was individually incorporated by reference.

FIELD OF THE PRESENT INVENTION

The present invention relates generally to an electrical connector, and more particularly to an electrical connector having a shielding function.

BACKGROUND OF THE PRESENT INVENTION

With fast development of computer technologies, the number of cores of a CPU is exponentially increased, and the CPU needs more terminals correspondingly which are used for transmitting signals. Accordingly, arrangement of the terminals is very compact, and signal interference is easily generated among the terminals. In order to achieve good shielding effect, an electrical connector generally used in the industry has a structure as follows.

The electrical connector has a body. A plurality of signal receiving slots and a plurality of grounding receiving slots are disposed in the body. The plurality of grounding receiving slots is arranged between the plurality of signal receiving slots alternately. A plurality of signal terminals and a plurality of grounding terminals are respectively and correspondingly received in the signal receiving slots and the grounding receiving slots. The grounding terminals are arranged between the signal terminals alternately, so as to avoid electromagnetic interference between the signal terminals, and to achieve shielding effect.

After assembly of the foregoing electrical connector, the electrical connector is welded to a circuit board. Generally, the industry takes the following manners to perform welding.

1. Both the plurality of signal terminals and the plurality of grounding terminals adopt a perforation manner, and are directly welded to the circuit board. By this manner, the terminals occupy the limited wiring space of the circuit board, which is unfavorable for the develop trend of precise and high-speed manufacturing, and causes strength reduction of the circuit board.

2. A plurality of tin balls is respectively and correspondingly pre-welded to the plurality of signal terminals and the plurality of grounding terminals. For convenience of implementation of pre-welding, the tin balls are all correspondingly located at the outside of the signal receiving slots and the grounding receiving slots. Then the signal terminals and the grounding terminals are conductively connected to a surface of the circuit board only through the tin balls. By this manner, the connection part between the signal terminals and the grounding terminals and the circuit board is weak. When the electrical connector is in transportation or under an action of any other external force, the connection is easily loosed, or even separated.

Therefore, a heretofore unaddressed need exists in the art to address the aforementioned deficiencies and inadequacies.

SUMMARY OF THE PRESENT INVENTION

In one aspect, the present invention is directed to an electrical connector having a shielding function.

In one embodiment, the electrical connector includes an insulating body, a plurality of signal terminals, at least one grounding terminal, a first conducting layer, and a solder. The insulating body is formed with a plurality of signal receiving slots and at least one grounding receiving slot. The plurality of signal terminals and the at least one grounding terminal are respectively received in the signal receiving slots and the grounding receiving slot. The first conducting layer is disposed in the grounding receiving slot and used for shielding the signal terminals. The solder is located in the grounding receiving slot and contacts the first conducting layer and the grounding terminal.

In one embodiment, a shielding layer is disposed on a surface of the insulating body. The shielding layer and the first conducting layer are conducted.

In one embodiment, the signal receiving slots does not have a shielding layer.

In one embodiment, the shielding layer includes an upper conducting layer and a lower conducting layer. The upper conducting layer and the lower conducting layer are respectively disposed on an upper surface and a lower surface of the insulating body.

In one embodiment, the upper conducting layer and the lower conducting layer are provided with an isolation area close to the periphery of each signal receiving slot, so that the signal terminals do not contact the upper conducting layer or the lower conducting layer.

In one embodiment, the grounding terminal has an elastic arm. The elastic arm has an abutting portion, and the abutting portion is located above the upper conducting layer.

In one embodiment, a plurality of through-holes is formed in the peripheral of each signal receiving slot. The through-holes are each internally disposed with a second conducting layer, where the shielding layer and the second conducting layer are conducted.

In one embodiment, the first conducting layer, the second conducting layer, the upper conducting layer and the lower conducting layer are conducted.

In one embodiment, the first conducting layer, the second conducting layer, the upper conducting layer and the lower conducting layer are electroplated metal layers or conductors made of a non-metal material.

In another aspect, the present application is directed to an electrical connector having a shielding function.

In one embodiment, the electrical connector includes an insulating body, a plurality of signal terminals, at least one grounding terminal, an upper conducting layer, a lower conducting layer, a first conducting layer, and at least one solder. The insulating body has a plurality of signal receiving slots and at least one grounding receiving slot through the insulating body. The plurality of signal terminals is respectively received in the plurality of signal receiving slots. The at least one grounding terminal is received in the grounding receiving slot. The upper conducting layer and the lower conducting layer are respectively disposed on an upper surface and a lower surface of the insulating body. The first conducting layer is disposed in the grounding receiving slot for shielding the signal terminals. The upper conducting layer, the lower conducting layer and the first conducting layer are conducted. The at least one solder is correspondingly received in the grounding receiving slot. The solder contacts both the grounding terminal and the first conducting layer.

In one embodiment, a plurality of through-holes is formed in peripheral of each signal receiving slot. The through-holes are each internally disposed with a second conducting layer.

In one embodiment, the first conducting layer, the second conducting layer, the upper conducting layer and the lower conducting layer are conducted.

In one embodiment, the first conducting layer, the second conducting layer, the upper conducting layer and the lower conducting layer are electroplated metal layers or conductors made of a non-metal material.

In one embodiment, the upper conducting layer and the lower conducting layer are provided with an isolation area close to the periphery of each of the signal receiving slots, so that the signal terminals do not contact the upper conducting layer or the lower conducting layer.

In one embodiment, the grounding terminal is extended upward with an elastic arm, the elastic arm has an abutting portion, and the abutting portion is located above the upper conducting layer.

In one embodiment, the upper conducting layer is formed with a conducting convex point at a place corresponding to each abutting portion.

In one embodiment, a groove is formed at the lower end of the grounding receiving slot, and the width of the groove is greater than the width of any other part of the grounding receiving slot.

In one embodiment, the grounding terminal has a base. The base is extended downward to form a welding portion. At least one part of the welding portion is located in the groove. The solder is accommodated in the groove, and the welding portion fixedly contacts the solder.

Compared with the related art, in certain embodiments of the present invention, the upper conducting layer disposed on the upper surface, the lower conducting layer disposed on the lower surface and the first conducting layer disposed in the grounding receiving slot are conducted to jointly form a shielding area. The shielding area isolates the plurality of signal terminals, so that interference among the plurality of signal terminals during signal transmission is avoided, and good shielding effect is achieved.

After assembly of the foregoing electrical connector, the electrical connector is welded to a circuit board, and the grounding terminal and the circuit board are connected through the solder. The solder is correspondingly received in the grounding receiving slot disposed with the first conducting layer. Comparing with that the grounding terminal and the circuit board are only contacted with the solder, the solder in certain embodiments of the present invention fixedly contacts the first conducting layer and the grounding terminal, so the connection between the electrical connector and the circuit board is stable.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the invention and together with the written description, serve to explain the principles of the invention. Wherever possible, the same reference numbers are used throughout the drawings to refer to the same or like elements of an embodiment.

DETAILED DESCRIPTION OF THE PRESENT INVENTION

Figure 1:
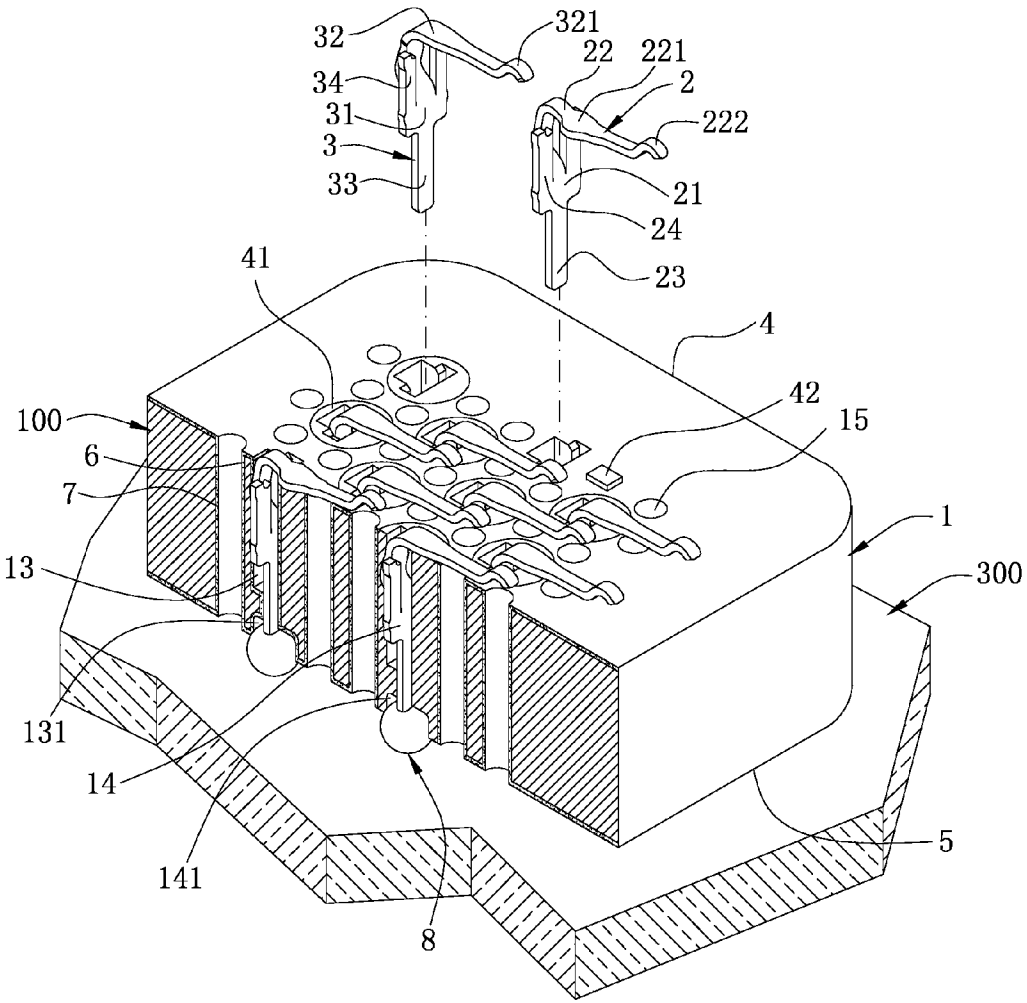
FIG. 1 is a three-dimensional partial exploded view of welding an electrical connector onto a circuit board according to one embodiment of the present invention.

The present invention will now be described more fully hereinafter with reference to the accompanying drawings, in which exemplary embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," or "includes" and/or "including" or "has" and/or "having" when used in this specification, specify the presence of stated features, regions, integers, steps, operations, elements, and/or components, but do not preclude the presence or addition of one or more other features, regions, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Figure 3:
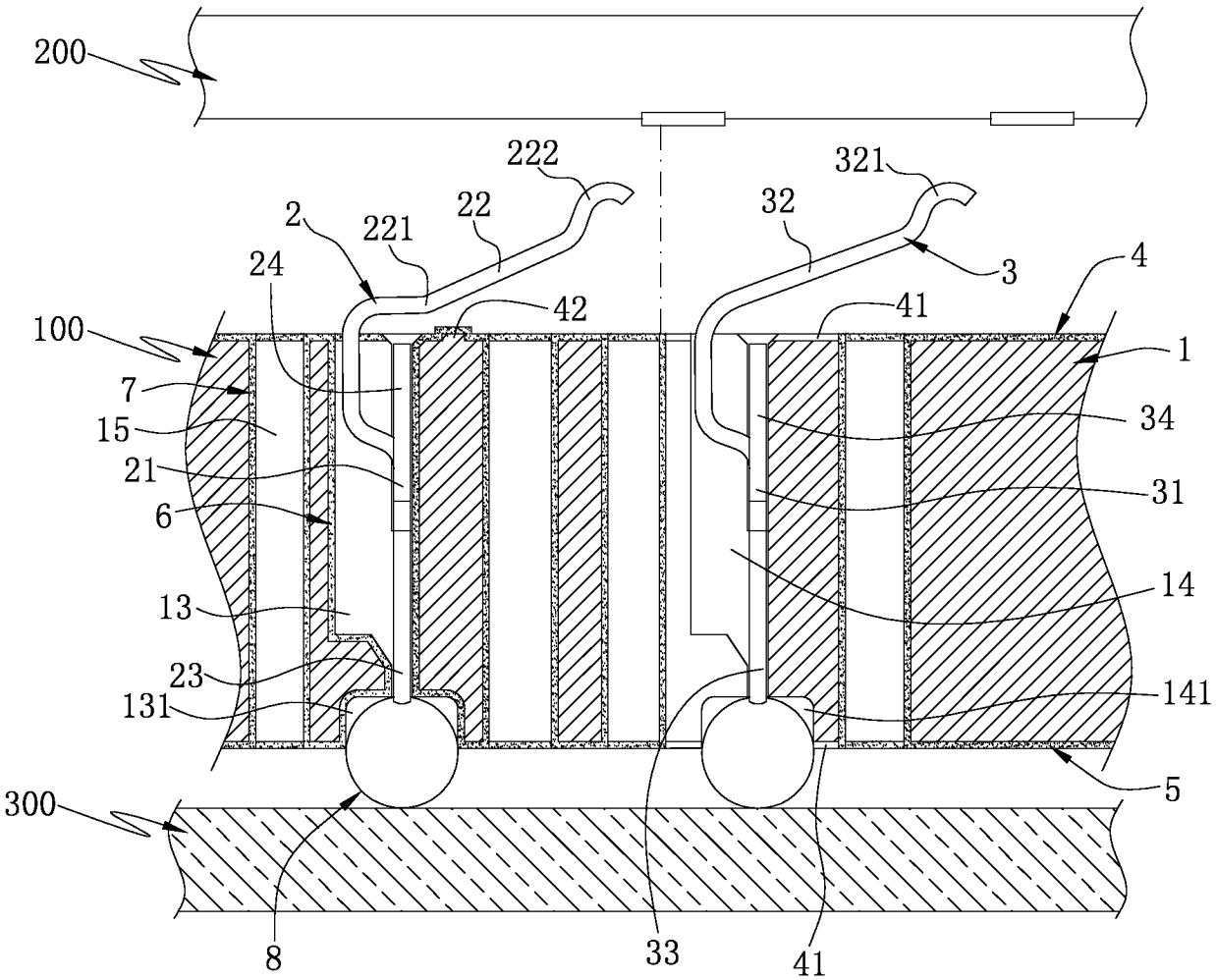
FIG. 3 is a schematic diagram when an electrical connector is not connected to a chip module according to one embodiment of the present invention.

Referring to FIG. 1 and FIG. 3, the present invention provides an electrical connector 100. The electrical connector 100 includes an insulating body 1, a plurality of grounding terminals 2 and a plurality of signal terminals 3 received in the insulating body 1, and an upper conducting layer 4 and a lower conducting layer 5 respectively disposed on upper and lower surfaces of the insulating body 1.

Referring to FIG. 3, a shielding layer is disposed on a surface of the insulating body 1. The shielding layer includes an upper conducting layer 4 and a lower conducting layer 5. The insulating body 1 has an upper surface and a lower surface which are arranged opposite to each other. The upper conducting layer 4 is disposed on the upper surface, and the lower conducting layer 5 is disposed on the lower surface. The upper conducting layer 4 is convexly provided with a conducting convex point 42. A plurality of grounding receiving slots 13 used for accommodating the grounding terminals 2 runs through from the upper surface to the lower surface. Each of the grounding receiving slots 13 is internally disposed with a first conducting layer 6, so that the grounding terminal 2 and the first conducting layer 6 are electrically conducted, and the shielding layer and the first conducting layer 6 are conducted. The first conducting layer 6, the upper conducting layer 4 and the lower conducting layer 5 are electrically conducted. The lower end of the grounding receiving slot 13 has a groove 131. The groove 131 is concavely formed upward from the lower surface, the groove 131 and the grounding receiving slot 13 are in communication, and the width of the groove 131 is greater than the width of any other part of the grounding receiving slot 13. In this embodiment, the grounding receiving slot 13 and the groove 131 are each internally disposed with the first conducting layer 6. In other embodiments, only the groove 131 is internally provided with the first conducting layer 6.

Referring to FIG. 3, a plurality of signal receiving slots 14 is formed by running through from the upper surface to the lower surface, for receiving the signal terminals 3. The signal receiving slot 14 is not internally provided with the first conducting layer 6, is not internally provided with the shielding layer, and is not internally provided with the upper conducting layer 4 or the lower conducting layer 5, so that the signal terminal 3 is insulated from the signal receiving slot 14. Multiple signal receiving slots 14 are distributed around each of the grounding receiving slots 13. The upper conducting layer 4 and the lower conducting layer 5 form an isolation area 41 through etching close to the periphery of the signal receiving slot 14. The isolation area 41 is used for preventing the signal terminal 3 from touching the upper conducting layer 4 to cause short-circuit. The signal terminal 3 does not contact the upper conducting layer 4 or the lower conducting layer 5, thereby ensuring that the signal terminal 3 is electrically isolated from the upper conducting layer 4 and the lower conducting layer 5. The lower end of the signal receiving slot 14 has a concave portion 141. The concave portion 141 is concavely formed upward from the lower surface, the concave portion 141 and the signal receiving slot 14 are in communication, and the width of the concave portion 141 is greater than the width of any other part of the signal receiving slot 14. The concave portion 141 is not provided with the first conducting layer 6 either. The upper conducting layer 4, the lower conducting layer 5 and the first conducting layer 6 are conducted to jointly form a shielding area (not shown), so that multiple signal terminals 3 between every two grounding terminals 2 are surrounded. The shielding area isolates the signal terminals 3, so that interference between the signal terminals 3 during signal transmission is avoided, and shielding effect is achieved.

Figure 2:
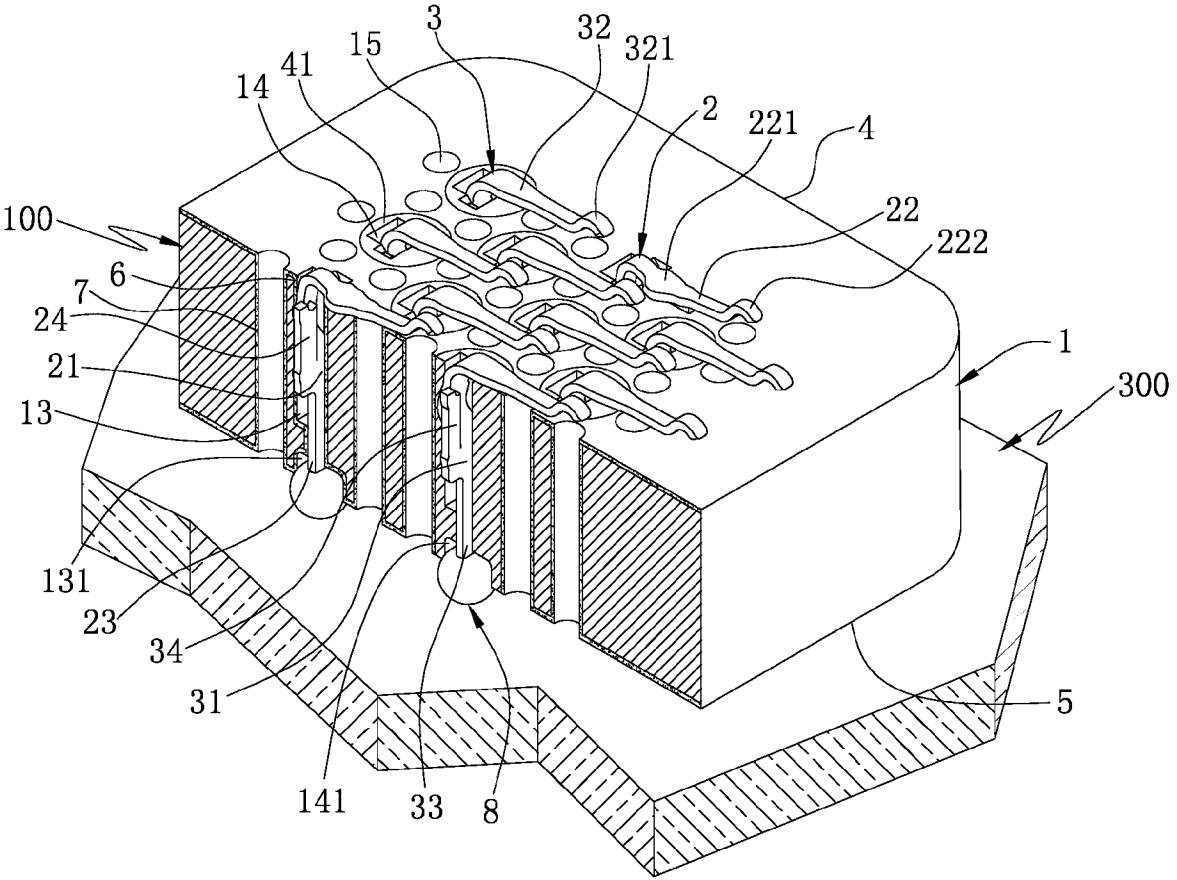
FIG. 2 is a three-dimensional assembly drawing of FIG. 1.

Referring to FIG. 2 and FIG. 3, the insulating body 1 further has a plurality of through-holes 15 running through from the upper surface to the lower surface. Each of the through-holes 15 is internally disposed with a second conducting layer 7. The second conducting layer 7, the upper conducting layer 4 and the lower conducting layer 5 are conductively connected, so that the first conducting layer 6, the second conducting layer 7, the upper conducting layer 4 and the lower conducting layer 5 are all electrically conducted. The upper conducting layer 4, the lower conducting layer 5 and the plurality of second conducting layers 7 are peripherally arranged to form a shielding space (not shown) to isolate the plurality of signal terminals 3, so that each of the signal terminals 3 is located in the whole shielding space, thereby preventing an external signal from entering the shielding space, and avoiding interference between the plurality of signal terminals 3. Therefore the shielding effect is good. Each of the signal receiving slots 14 is peripherally and uniformly provided with multiple through-holes 15. In this embodiment, each of the signal receiving slots 14 is peripherally distributed with six through-holes 15, each of the through-holes 15 is at a same distance from the signal receiving slot 14. In other embodiments, the number of the through-holes 15 may be changed according to demands, and the through-holes 15 may also locate at different distances from the signal receiving slot 14, as long as the through-holes 15 enclose each of the signal receiving slots 14 to form a ring, which encircles the signal receiving slot 14, and provides metal shielding.

In this embodiment, the upper conducting layer 4, the lower conducting layer 5, the first conducting layer 6 and the second conducting layer 7 are formed by electroplating a metal material. Alternatively, the layers may be formed by coating or dipping. In another embodiment, the upper conducting layer 4, the lower conducting layer 5, the first conducting layer 6 and the second conducting layer 7 can also be formed by disposing a conductor made of a non-metal material.

Figure 4:
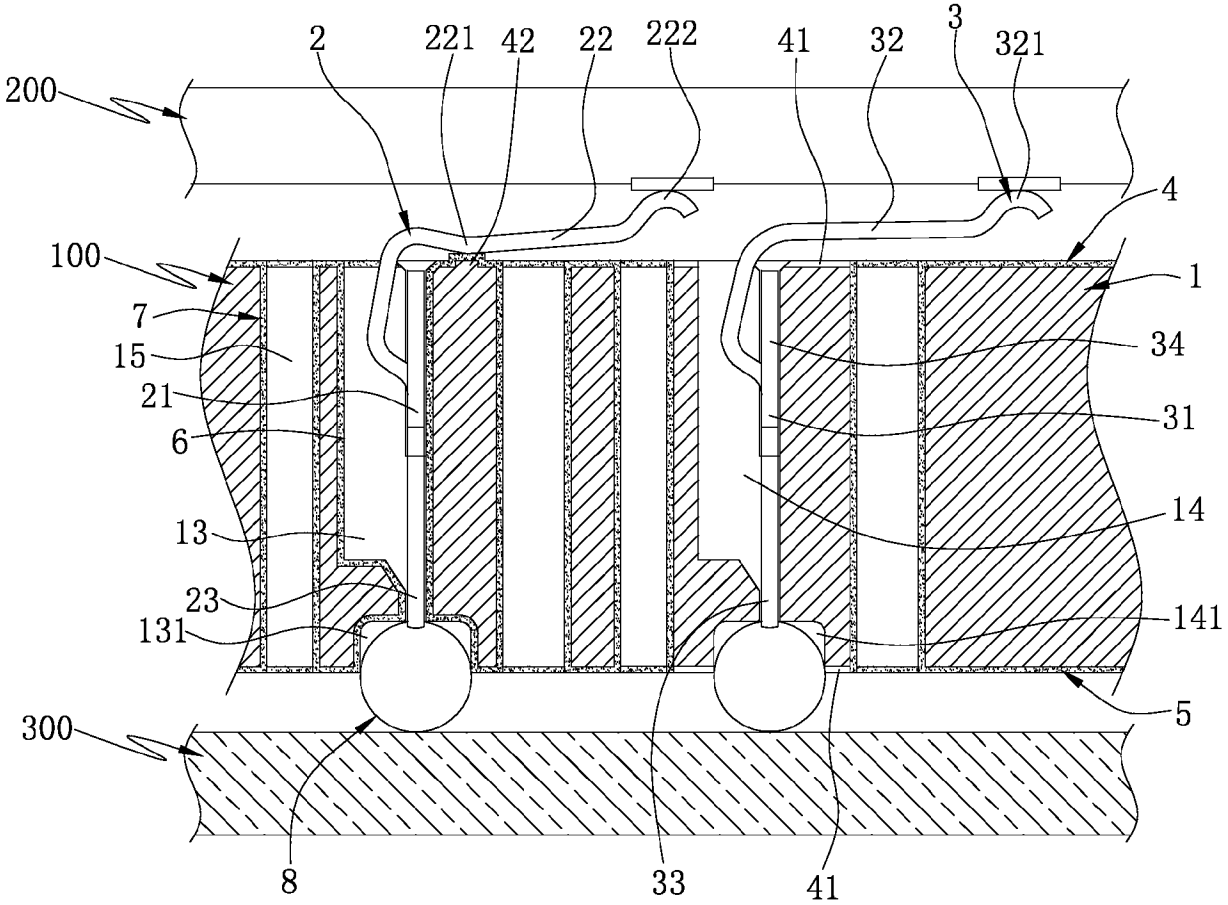
FIG. 4 is a schematic diagram when an electrical connector is connected to a chip module according to one embodiment of the present invention.

Referring to FIG. 3 and FIG. 4, the grounding terminal 2 is received in the grounding receiving slot 13. The grounding terminal 2 has a base 21 located in the grounding receiving slot 13. The base 21 is extended upward to form an elastic arm 22. A part of the elastic arm 22 is exposed out of the grounding receiving slot 13. The elastic arm 22 has an abutting portion 221. The abutting portion 221 is located above the upper conducting layer 4. The conducting convex point 42 and the abutting portion 221 are correspondingly disposed. The abutting portion 221 is extended upward with a contact portion 222 used for mating a chip module 200. When the chip module 200 abuts and presses the contact portion 222, the abutting portion 221 moves downward and abuts the conducting convex point 42. The base 21 is extended downward with a welding portion 23. A part of the welding portion 23 is located in the groove 131. The base 21 is extended to each of two sides with a holding portion 24. The holding portion 24 is used for fixing the grounding terminal 2 in the grounding receiving slot 13.

Referring to FIG. 3 and FIG. 4, the signal terminal 3 is received in the signal receiving slot 14. The signal terminal 3 has a main body 31 located in the signal receiving slot 14. The main body 31 is extended upward with an extending arm 32. At least one part of the extending arm 32 is located above the upper surface. An end of the extending arm 32 has a pressing portion 321. The pressing portion 321 and the chip module 200 are conductively connected. The main body 31 is extended downward with a welding foot 33. A part of the welding foot 33 is located in the concave portion 141. The main body 31 is extended to each of two sides with a fastening portion 34. The fastening portion 34 is used for fixing the signal terminal 3 in the signal receiving slot 14.

Referring to FIG. 2 and FIG. 3, a plurality of solders 8 is correspondingly received in a plurality of signal receiving slots 14 and the plurality of grounding receiving slots 13, and is used for welding the electrical connector 100 onto a circuit board 300. In this embodiment, the solders 8 are tin balls. The solders 8 are respectively accommodated in the groove 131 and the concave portion 141. The first conducting layer 6 is electrically conducted with the welding portion 23 through the solder 8. When the grounding terminal 2 is welded to the circuit board 300, the solder 8 is melted and filled in the groove 131. Not only the welding portion 23 is firmly welded onto the circuit board 300, but also the first conducting layer 6 in the groove 131 is welded onto the circuit board 300, thereby enhancing welding firmness. Even if the electrical connector 100 is bumped by an external force, the location of the welding portion 23 is not easily loose, so that the connection between the electrical connector 100 and the circuit board 300 is stable.

Referring to FIG. 2 and FIG. 4, during assembly, firstly the plurality of signal terminals 3 and the plurality of grounding terminals 2 are correspondingly installed into the plurality of signal receiving slots 14 and the plurality of grounding receiving slots 13, respectively. Then the solders 8 are pre-welded onto the welding portion 23 and the welding foot 33. The fastening portion 34 is clamped in the signal receiving slot 14 to fix the signal terminal 3. A part of the extending arm 32 is extended out of the upper surface, the pressing portion 321 is located above the upper conducting layer 4, and a sufficient distance is kept between the pressing portion 321 and the upper conducting layer 4, to ensure that the pressing portion 321 never touches the upper conducting layer 4. The welding foot 33 and the solder 8 are located in the concave portion 141.

Referring to FIG. 2 and FIG. 4, the holding portion 24 is held in the grounding receiving slot 13 to fix the grounding terminal 2. The abutting portion 221 is located above the conducting convex point 42. The welding portion 23 and the solder 8 are located in the groove 131. When the electrical connector 100 and the circuit board 300 are welded, the solder 8 is melted in the groove 131. The solder 8 is melted and filled in the groove 131, not only the welding portion 23 is firmly welded onto the circuit board 300, but also the first conducting layer 6 in the groove 131 is welded onto the circuit board 300, thereby enhancing welding firmness. Even if the electrical connector 100 is bumped by an external force, the location of the welding portion between the welding portion 23 and the circuit board 300 is still not easily loose, so that the connection between the electrical connector 100 and the circuit board 300 is stable.

Referring to FIG. 3 and FIG. 4, in operation, the chip module 200 is in a pressing connection with the signal terminal 3 and the grounding terminal 2. The extending arm 32 moves downward to approximate to the upper conducting layer 4 and keep an interval, and the isolation area 41 may ensure that when moving downward, the extending arm 32 does not contact the upper conducting layer 4. Meanwhile, the chip module 200 is in a pressing connection with the contact portion 222. The elastic arm 22 moves downward, and the abutting portion 221 and the conducting convex point 42 are contacted and are thereby electrically conducted. At this time, the supporting point of the arm of force of the elastic arm 22 is the closest to the contact portion 222, so that the arm of force is shortened to enable the elasticity of the elastic arm 22 to be reduced, and the strength thereof to be increased, so as to ensure that the contact portion 222 stably contacts the chip module 200. When being vibrated under the action of an external force, the electrical connector 100 is not instantaneously disconnected.

When an electric signal is transmitted to pass through the signal terminals 3, an interference signal is generated between two signal terminals 3, and the interference signal is transmitted from the contact portion 222 to the abutting portion 221. The abutting portion 221 and the upper conducting layer 4 are contacted and electrically conducted, so the interference signal is transmitted to the upper conducting layer 4, and finally conducted onto the circuit board 300 via the upper conducting layer 4, the second conducting layer 7, the grounding terminal 2 and the lower conducting layer 5. The interference signal is transmitted by selecting a shortest conducting path through the grounding terminal 2 or the second conducting layer 7, so that the interference signal is quickly conducted out, thereby avoiding generation of crosstalk interference, satisfying high frequency demands of the electrical connector 100, and achieving perfect shielding effect.

In summary, the electrical connector 100 according to certain embodiment of the present invention, among other things, has the following beneficial effects:

(1) The upper conducting layer 4, the lower conducting layer 5 and the first conducting layer 6 are conducted to jointly form a shielding area. The shielding area isolates the plurality of signal terminals 3, so that interference between the plurality of signal terminals 3 during signal transmission is avoided, and good shielding effect is achieved.

(2) The upper conducting layer 4, the lower conducting layer 5 and the plurality of second conducting layers 7 are surroundingly arranged to form a shielding space to isolate the plurality of signal terminals 3, so that each of the signal terminals 3 is located in the whole shielding space, thereby preventing an external signal from entering the shielding space, interference between the signal terminals 3 is small, and the shielding effect is enhanced.

(3) The upper conducting layer 4 and the lower conducting layer 5 are provided with an isolation area 41 close to the periphery of each of the signal receiving slots 14. The isolation area 41 prevents the extending arm 32 of the signal terminal 3 from touching the upper conducting layer 4 when the extending arm 32 is pressed downward, which causes short-circuit between the signal terminals 3.

(4) When the grounding terminal 2 is welded to the circuit board 300, the solder 8 is melted and filled in the groove 131. Not only the welding portion 23 is firmly welded onto the circuit board 300, but also the first conducting layer 6 in the groove 131 is welded onto the circuit board 300, thereby enhancing welding firmness. Even if the electrical connector 100 is bumped by an external force, the welding location between the welding portion 23 and the circuit board 300 is also not easily loose, so that the connection between the electrical connector 100 and the circuit board 300 is stable.

(5) The abutting portion 221 and the upper conducting layer 4 are contacted and electrically conducted, so the interference signal is transmitted to the upper conducting layer 4, and finally conducted onto the circuit board 300 via the upper conducting layer 4, the second conducting layer 7, the grounding terminal 2 and the lower conducting layer 5. The interference signal is transmitted by selecting a shortest conducting path through the grounding terminal 2 or the second conducting layer 7, so that the interference signal is quickly conducted out, thereby avoiding generation of crosstalk interference, satisfying high frequency demands of the electrical connector 100, and achieving perfect shielding effect.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments are chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein

What is claimed is:

1. An electrical connector, comprising:

an insulating body, having a plurality of signal receiving slots and at least one grounding receiving slot;

a plurality of signal terminals and at least one grounding terminal, respectively received in the signal receiving slots and the grounding receiving slot;

a first conducting layer, disposed in the grounding receiving slot for shielding the signal terminals;

a plurality of through-holes surrounding each signal receiving slot, and each through-hole is disposed internally with a second conducting layer; and a solder, contacting the first conducting layer and the grounding terminal.

2. The electrical connector according to claim 1, further comprising a shielding layer disposed on a surface of the insulating body, wherein the shielding layer and the first conducting layer are conducted.

3. The electrical connector according to claim 2, wherein the shielding layer does not extend to the signal receiving slots.

4. The electrical connector according to claim 2, wherein the shielding layer comprises an upper conducting layer and a lower conducting layer respectively disposed on an upper surface and a lower surface of the insulating body.

5. The electrical connector according to claim 4, wherein the upper conducting layer and the lower conducting layer are provided with an isolation area close to the periphery of each signal receiving slot, so that the signal terminals do not contact the upper conducting layer or the lower conducting layer.

6. The electrical connector according to claim 4, wherein the grounding terminal has an elastic arm, the elastic arm has an abutting portion, and the abutting portion is located above the upper conducting layer.

7. The electrical connector according to claim 4, wherein the shielding layer and the second conducting layer are conducted.

8. The electrical connector according to claim 4, wherein the first conducting layer, the second conducting layer, the upper conducting layer and the lower conducting layer are electroplated metal layers or conductors made of a non-metal material.

9. An electrical connector, comprising:

an insulating body, having a plurality of signal receiving slots and at least one grounding receiving slot formed through the insulating body;

a plurality of signal terminals, respectively received in the plurality of signal receiving slots, and at least one grounding terminal, received in the grounding receiving slot;

an upper conducting layer and a lower conducting layer, respectively disposed on an upper surface and a lower surface of the insulating body;

a first conducting layer, disposed in the grounding receiving slot for shielding the signal terminals, wherein the upper conducting layer, the lower conducting layer and the first conducting layer are conducted;

a plurality of through-holes surrounding each signal receiving slot; and at least one solder, wherein the solder contacts both the grounding terminal and the first conducting layer.

10. The electrical connector according to claim 9, wherein each through-hole is disposed internally with a second conducting layer.

11. The electrical connector according to claim 10, wherein the upper conducting layer and the lower conducting layer do not extend to the signal receiving slots.

12. The electrical connector according to claim 10, wherein the first conducting layer, the second conducting layer, the upper conducting layer and the lower conducting layer are conducted.

13. The electrical connector according to claim 10, wherein the first conducting layer, the second conducting layer, the upper conducting layer and the lower conducting layer are electroplated metal layers or conductors made of a non-metal material.

14. The electrical connector according to claim 9, wherein the upper conducting layer and the lower conducting layer are provided with an isolation area close to the periphery of each signal receiving slot, so that the signal terminals do not contact the upper conducting layer or the lower conducting layer.

15. The electrical connector according to claim 9, wherein the grounding terminal has an elastic arm extended upward, the elastic arm has an abutting portion, and the abutting portion is located above the upper conducting layer.

16. The electrical connector according to claim 15, wherein the upper conducting layer comprises a plurality of conducting convex points, each located at a place corresponding to one of the abutting portions.

17. The electrical connector according to claim 9, wherein a lower end of the grounding receiving slot has a groove, and a width of the groove is greater than a width of any other part of the grounding receiving slot.

18. The electrical connector according to claim 17, wherein the grounding terminal has a base, the base is extended downward with a welding portion, at least one part of the welding portion is located in the groove, the solder is accommodated in the groove, and the welding portion fixedly contacts the solder.

* * * * *